US007799281B2

(12) United States Patent
Cook et al.

(10) Patent No.: US 7,799,281 B2
(45) Date of Patent: Sep. 21, 2010

(54) FLUX CONCENTRATOR FOR BIOMAGNETIC PARTICLE TRANSFER DEVICE

(75) Inventors: Douglas Lee Cook, Milwaukee, WI (US); Thomas E. Bray, Milwaukee, WI (US)

(73) Assignee: Festo Corporation, Hauppauge, NY (US)

( * ) Notice: Subject to any disclaimer, the term of this patent is extended or adjusted under 35 U.S.C. 154(b) by 226 days.

(21) Appl. No.: 12/014,956

(22) Filed: Jan. 16, 2008

(65) Prior Publication Data

US 2008/0170966 A1 Jul. 17, 2008

Related U.S. Application Data

(60) Provisional application No. 60/880,681, filed on Jan. 16, 2007.

(51) Int. Cl.
*B03C 1/02* (2006.01)

(52) U.S. Cl. ..... 422/101; 436/177; 422/99; 422/100; 210/695

(58) Field of Classification Search ..... 422/99, 422/100, 101; 210/695; 436/177
See application file for complete search history.

(56) References Cited

U.S. PATENT DOCUMENTS

| | | | | |
|---|---|---|---|---|
| 4,292,920 | A | 10/1981 | Smith et al. | |
| 5,288,468 | A | 2/1994 | Church et al. | |
| 5,567,326 | A | 10/1996 | Ekenberg et al. | |
| 5,779,907 | A | 7/1998 | Yu | |
| 6,040,192 | A | 3/2000 | Tuunanen | |
| 6,297,062 | B1 | 10/2001 | Gombinski | |
| 6,409,925 | B1 | 6/2002 | Gombinsky et al. | |
| 6,780,648 | B1 | 8/2004 | Sun | |
| 2001/0055545 | A1 | 12/2001 | Takii et al. | |
| 2005/0035143 | A1 | 2/2005 | Massaro et al. | |
| 2005/0132822 | A1 | 6/2005 | Massaro | |
| 2006/0118494 | A1 * | 6/2006 | Rundt et al. | 436/174 |
| 2006/0266130 | A1 | 11/2006 | Zobel et al. | |
| 2006/0269385 | A1 | 11/2006 | Zobel et al. | |

FOREIGN PATENT DOCUMENTS

| | | |
|---|---|---|
| WO | WO 87/05536 | 9/1987 |
| WO | WO 94/18565 | 8/1994 |
| WO | WO 95/00247 | 1/1995 |
| WO | WO 96/09550 | 3/1996 |
| WO | WO 96/12959 | 5/1996 |
| WO | WO 99/40444 | 8/1999 |
| WO | WO 99/42832 | 8/1999 |
| WO | WO 02/49761 A2 | 6/2002 |
| WO | WO 03/085407 A1 | 10/2003 |
| WO | WO 03/090897 A1 | 11/2003 |

(Continued)

*Primary Examiner*—Jill Warden
*Assistant Examiner*—Sharon Pregler
(74) *Attorney, Agent, or Firm*—Hoffmann & Baron, LLP

(57) ABSTRACT

A tip for a biomagnetic particle transfer device generally includes a solid body made from a highly magnetically permeable material and having a shape adapted to concentrate a magnetic field generated by the transfer device on the body. The tip body preferably includes a truncated cone-shaped portion and a solid probe portion. The cone-shaped portion defines an attachment end engageable with an end of the transfer device and an apex opposite the attachment end. The probe portion extends from the apex of the cone-shaped portion, and the magnetic field is concentrated on the probe portion.

5 Claims, 10 Drawing Sheets

FOREIGN PATENT DOCUMENTS

| | | | |
|---|---|---|---|
| WO | WO 2004/009238 | A1 | 1/2004 |
| WO | WO 2004/009300 | A1 | 1/2004 |
| WO | WO 2004/035217 | A1 | 4/2004 |
| WO | WO 2004/069413 | A1 | 8/2004 |
| WO | WO 2005/065831 | A1 | 7/2005 |

* cited by examiner

FLUX CONCENTRATOR FOR BIOMAGNETIC PARTICLE TRANSFER DEVICE

CROSS-REFERENCE TO RELATED APPLICATIONS

This application claims the benefit of U.S. Provisional Application No. 60/880,681, filed on Jan. 16, 2007, which is incorporated by reference herein in its entirety for all purposes.

BACKGROUND OF THE INVENTION

The present invention relates generally to the field of analytical separation and combining of samples and, more particularly, to a temporarily magnetizable biomagnetic particle collection, extraction and transfer device and a magnetic flux concentrator therefor.

Analytic and diagnostic procedures in the laboratory often require the transfer of a plurality of samples, simultaneously, from one array of liquid-containing wells to another. In order to transfer, add, collect or combine liquids, various multi-transferring systems have been devised. The most commonly used is a multi-pipette which collects liquid from an array of source wells for transfer to an array of target wells by application or release of application, respectively, of vacuum force. In operation, the pipette for collecting or releasing of liquid is connected to a single vacuum source provided to all the pipettes in the system so that all samples in the array of wells are collected and released at once.

In recent years, magnetic particles have been used for a variety of separation, purification, and isolation techniques in connection with chemical or biological molecules. In those techniques, a molecule is coupled to a magnetic particle capable of forming a specific binding with a molecule in a biological sample, which is to be isolated, purified or separated. The biological sample is then brought into contact with the magnetic particle and those biological molecules which bind to the magnetic particles are then isolated by application of a magnetic field.

Various devices have been developed to utilize such magnetic separation techniques in order to transfer the magnetic particles from one location to another. For example, U.S. Pat. No. 4,292,920 discloses a device including a single or multi-pin arrangement, corresponding to a micro-well arrangement, which is capable of insertion into the wells of a micro-plate to attract magnetic particles by magnetic force. In one embodiment, the pin is connected to an electromagnet, and by turning the electromagnet on and off the pin becomes magnetized, or non-magnetized, respectively.

U.S. Pat. No. 5,567,326 shows an apparatus and method for separating magnetically responsive particles from a nonmagnetic test medium in which they are suspended. The device comprises a plurality of nonmagnetic pins arranged in an array, and a magnet positioned normal to the array. Placing the magnet on the array of pins renders all the pins in the array magnetic thereby causing particles to be attracted to them. Removing the magnet causes the pins to become non-magnetic, and consequently the magnetic particles are released from the pins.

U.S. Pat. No. 6,409,925 to Gombinsky et al. discloses a device wherein each collecting pin can be independently controlled. Specifically, the disclosed magnetic rod design allows for a magnet disposed therein to be freely and independently movable up or down to thereby magnetically energize and de-energize the rod. Thus, each rod is independently magnetized regardless of the magnetization of the other rods.

Commonly owned U.S. Patent Application Publication No. 2006-0266130 discloses a transfer unit for transferring a sample, such as a biomagnetic particle sample, from a source vessel to a target vessel. The transfer unit includes a transfer device having a pin tip with a central bore terminating at a bottom wall, an actuating element, such as a magnet, movably disposed in the pin tip bore and an actuator rod for moving the actuating element. The actuator rod moves the actuating element between a first position adjacent the tip bottom wall and a second position away from the bottom wall. Movement of the actuating element causes a sample in proximity to the pin tip to be alternately collected and released from the pin tip.

The above described devices all have certain drawbacks. One drawback resides in the fact that the ends of the magnetic rods or pins must come into direct contact with the magnetic particles in the liquid sample to ensure a sufficiently strong magnetic field to collect the particles. To protect the magnet elements and/or pins from contaminants, plastic tips are provided over the ends of the pins, which must be loaded and unloaded between applications. Additionally, the tips must be extremely thin-walled (e.g., less than 20 micrometers) to permit the magnetic field to pass therethrough without diminishing in strength. Such thin-walled tips are difficult to manufacture and are expensive. Moreover, in most applications, rinsing and sterilization is required wherein the tips must be removed from the pins and subsequently replaced. Such thin-walled tips are difficult to handle and are not particularly durable to withstand rinsing and sterilization.

Another trend in the field is to reduce the overall size of the sample wells while simultaneously increasing the number of wells within an array. As a result, pins having smaller diameters must be utilized and these pins must be arranged in closer proximity to one another. Placing pins in close proximity to one another raises the challenge of minimizing the effects of magnetic fields between adjacent pins so that the magnetic field applied in one sample well will not affect the magnetic particles in a neighboring well. Also, reducing the diameter of the pins means using a smaller magnetic element having a weaker magnetic strength.

Accordingly, it would be desirable to provide a tip to a biomagnetic particle transfer device which is inexpensive to manufacture, yet durable enough to withstand repeated use with washing and sterilization between each use. It would be further desirable to provide such a tip which enhances the magnetic strength of a magnetic pin, particularly in compact arrangements.

SUMMARY OF THE INVENTION

The present invention is a magnetizable tip made from a highly magnetically permeable material, and which has a geometry adapted to concentrate a magnetic field at an end of the tip. In this regard, the tip has the shape of a truncated cone and is preferably removably attached to an end of a biomagnetic particle transfer pin having a selectively activatable magnet element disposed therein.

In a preferred embodiment, the tip includes a truncated cone-shaped portion and a needle-like probe portion. The cone-shaped portion defines an attachment end engageable with an end of the transfer device and an apex opposite the attachment end. The solid probe portion extends from the apex of the cone-shaped portion and the magnetic field is concentrated on the probe portion. The cone-shaped portion preferably includes an inner spherically shaped recess to receive a spherically shaped end pole of a magnet of the transfer device and the probe portion is preferably a narrow elongate solid cylinder. The probe portion can also have a corrugated outer surface and the entire tip body can have a biological agent coating.

The present invention further involves a biomagnetic particle transfer device. The device generally includes a pin having a tip end and a tip engageable with the tip end. The pin includes a magnet element disposed therein and the tip is made from a highly magnetically permeable material and has a shape adapted to concentrate a magnetic field generated by the magnet element in the pin on the tip.

The present invention can also take the form of a tip array for a biomagnetic particle transfer device. The tip array includes a plurality of tips engageable with a magnetic element of the transfer device and a unitary frame supporting the plurality of tips. Each of the tips is made from a highly magnetically permeable material and has a shape adapted to concentrate a magnetic field generated by the magnetic element of the transfer device on the tip.

When in the form of a tip array, the present invention further provides a biomagnetic particle transfer device, which includes the array and at least one magnetic element adapted for selectively generating a magnetic field. In this case, the transfer device can have fewer magnetic elements than tips.

The pin for which the magnetizable tip is used generally includes a hollow pin body terminating at an open end and a magnet slidably disposed within the hollow pin body. The magnetizable tip is attached to the open end of the pin and a magnet actuator system drives the magnet within the hollow pin body to move from a first position adjacent the tip to a second position away from the tip. When the magnet is adjacent the tip, the magnetic force is applied at the tip, for attracting biomagnetic particles to the tip, and when the magnet is away from the tip, the magnetic force is removed from tip.

In a preferred embodiment, a transfer device is provided which includes an array of pins and a magnet actuator system for selectively applying and removing the magnetic force at the end of at least one pin of the pin array. In this embodiment, the magnetizable tip of the present invention is also provided in an array matching in number and spacing as that of the pins. The tips can thus be removed from the pins as a single unit.

The preferred embodiments of the magnetizable tip as well as other objects, features and advantages of this invention, will be apparent from the following detailed description, which is to be read in conjunction with the accompanying drawings.

DETAILED DESCRIPTION OF THE PREFERRED EMBODIMENTS

Figure 1:
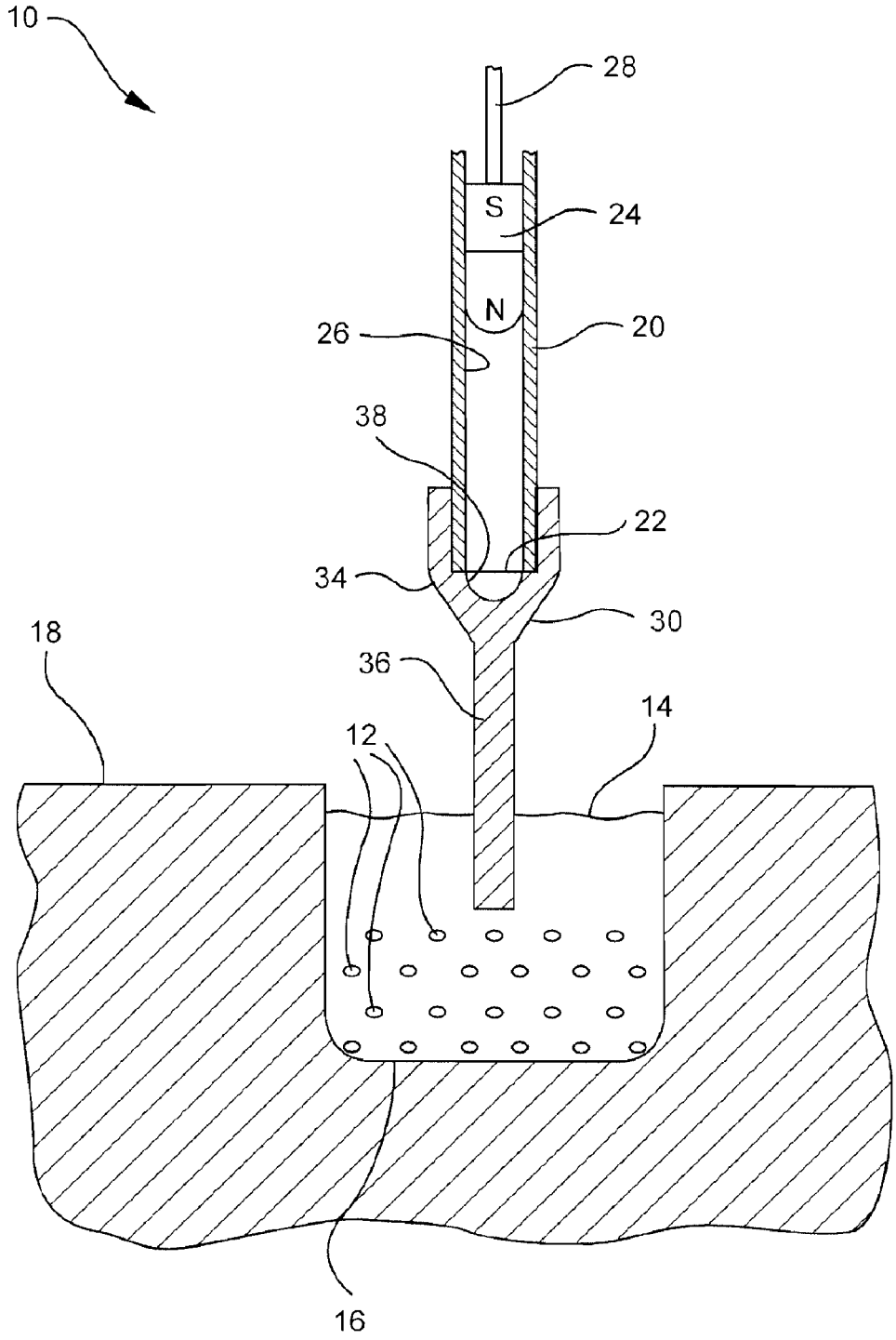
FIG. 1 is a cross-sectional view of a biomagnetic particle transfer pin with a magnetizable tip according to the present invention attached thereto, wherein the magnet of the pin is shown in a retracted position.
Figure 2:
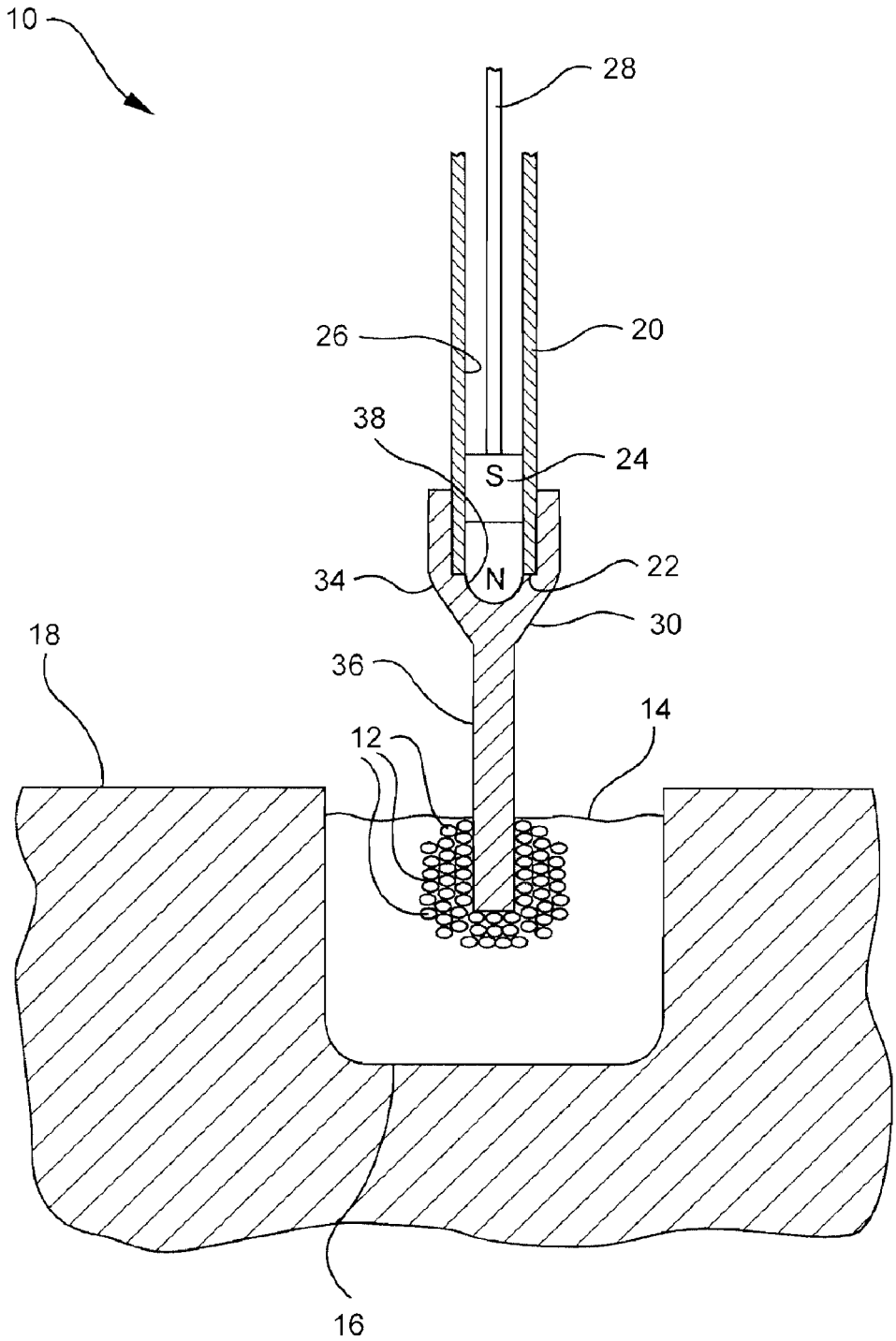
FIG. 2 is a cross-sectional view of the pin shown in FIG. 1, wherein the magnet of the pin is shown in an extended position to attract biomagnetic particles in a sample well.

Referring first to FIGS. 1 and 2, a biomagnetic particle transfer device 10 is shown. The intent of this device 10 is to allow for the collection and extraction of magnetic particles 12 (such as superparamagnetic particles treated for the bonding of biological agents) from a suspension 14 (though they may have settled out or agglomerated) contained in a sample well 16 of a microplate 18 and the subsequent deposition of those particles into another suspension. One application of this device would be in the separation and purification of biological samples.

The transfer device 10 generally includes a tubular pin 20 having an open end 22 and a permanent magnet 24 slidably disposed within a central bore 26 of the pin. The magnet 24 is driven by an actuator system (not shown) via a rod or cable 28 between a retracted position, as shown in FIG. 1, wherein the magnet is removed from the open end 22 of the pin 22, to an extended position, as shown in FIG. 2, wherein the magnet is positioned at or immediately adjacent the open end of the pin. As will be discussed in further detail below, when the transfer device 10 is positioned within a sample well 16, and the magnet 24 is in its extended position, a magnetic field is applied, which attracts the biomagnetic particles 12 within the suspension 14 to the end of the transfer device.

Attached to the open end 22 of the pin 20 is a magnetizable tip 30 according to the present invention. The tip 30 may be attached to the pin 20 in any conventional manner, such as by an adhesive. However, in a preferred embodiment, the tip 30 is removably attached to the end of the pin, such as by a snap-fit or press-fit connection, as shown in FIGS. 1 and 2.

Figure 3:
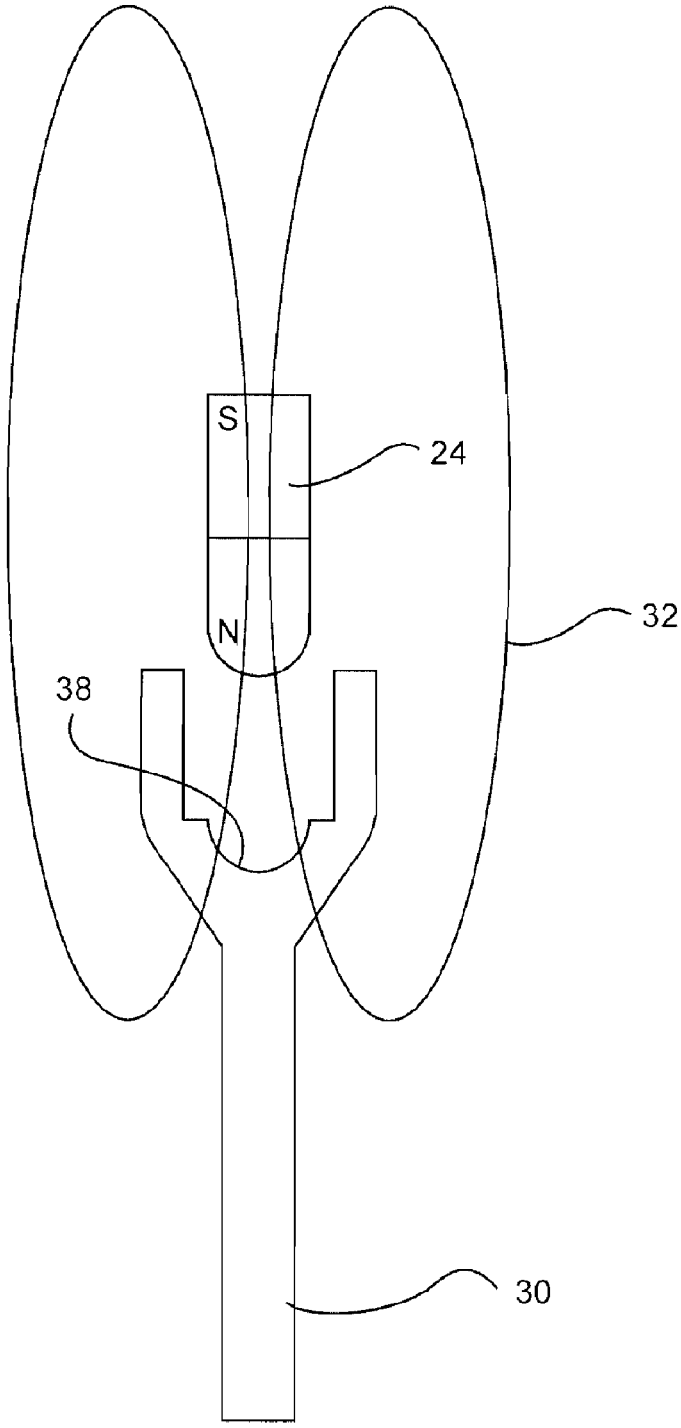
FIG. 3 is a diagrammatic side illustration of the magnetizable tip according to the present invention showing the magnetic flux lines of a magnet in a retracted position with respect to the tip.
Figure 4:
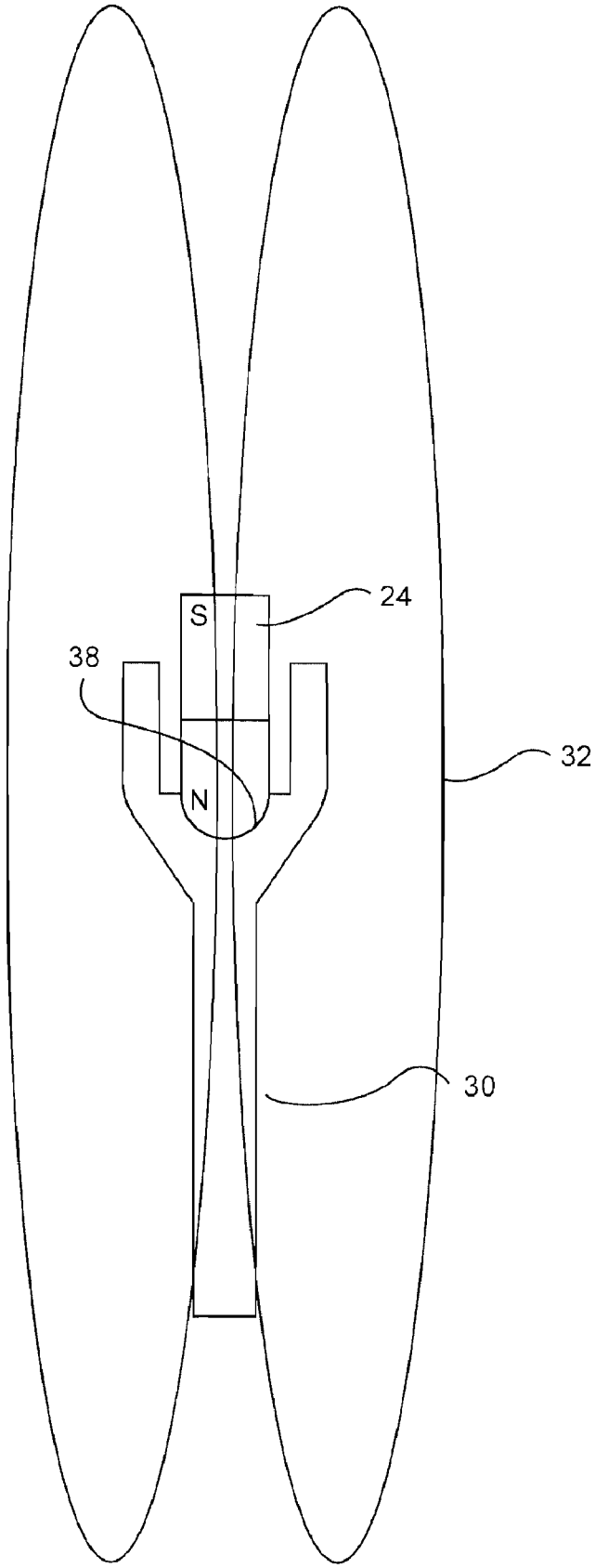
FIG. 4 is a diagrammatic side illustration of the magnetizable tip according to the present invention showing the magnetic flux lines of a magnet in an extended position adjacent to the tip.
Figure 5:
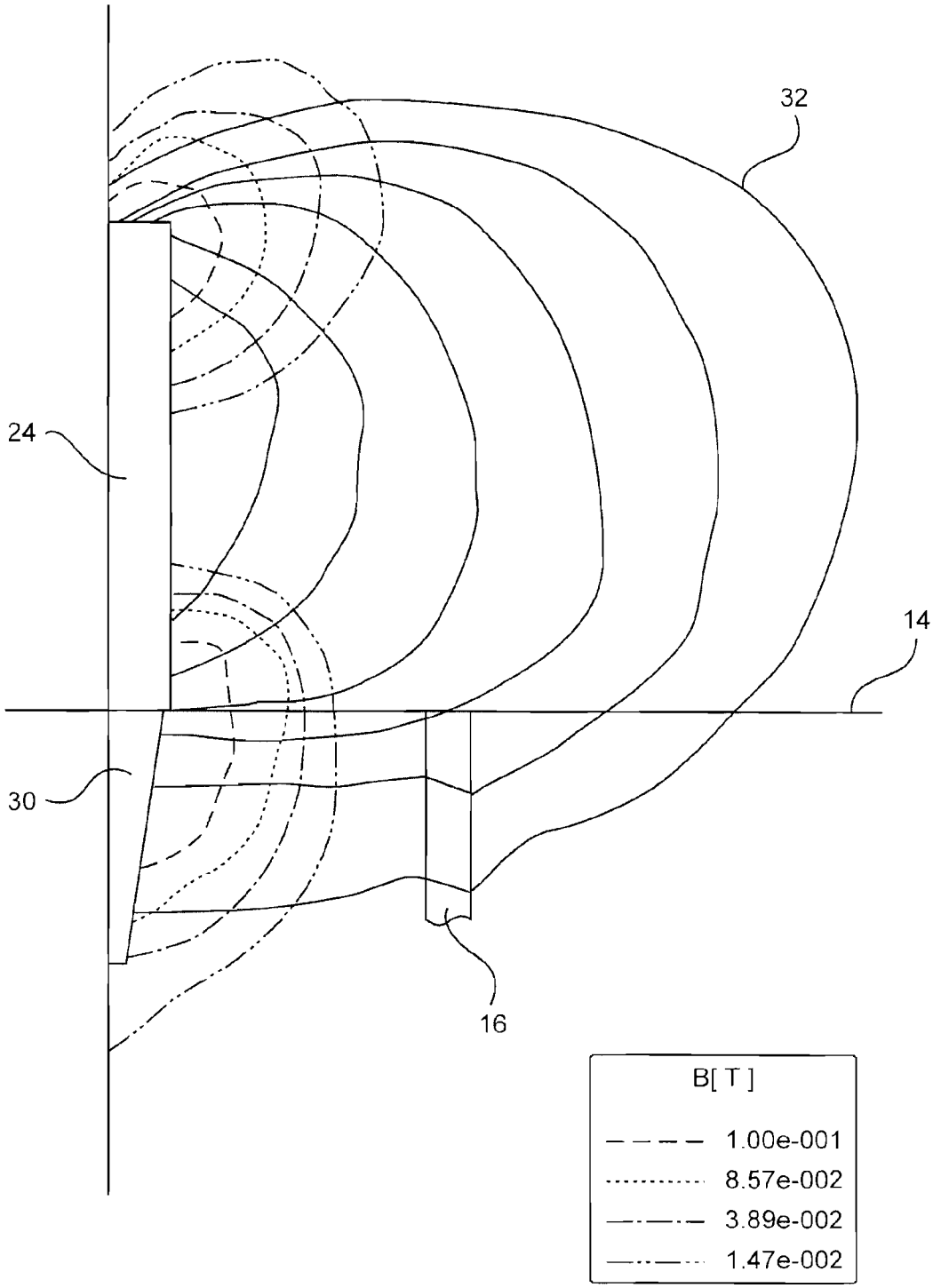
FIG. 5 is a graphical representation of the magnetic flux lines of a magnet with the magnetizable tip of the present invention attached.

The tip 30, also termed a flux concentrator, is a solid element made from a material of relatively high magnetic permeability, such as 1010 steel, which distributes an applied magnetic field across its surface as defined by its designed geometry. In particular, as shown in FIGS. 3-5, the tip 30 distributes the magnetic field 32 supplied by the permanent magnet 24 along the tip's length thereby drawing the biomagnetic particles 12 to the tip. FIGS. 3 and 4 are conceptual sketches showing a permanent magnet 24 as the magnetic-field source and the resulting path change of the magnetic flux 32 when the magnet is brought into contact with the tip 30. FIG. 5 is an Ansoft Maxwell axisymmetric simulation showing the distribution of the magnetic field 32 along the tip's length (lower left, an inverted truncated cone) while the upper pole of the permanent magnet 24 (upper left) shows a concentration of the magnetic field. The biomagnetic particles would be held in suspension around the tip 24 (below the white horizontal line).

The geometry of the tip 30 determines the flux paths for the magnetic field 32. In a preferred embodiment, the tip 30 includes a cone-shaped portion 34 and a solid needle-like probe portion 36 extending from the apex of the cone portion, which directs the magnetic flux. The cone portion 34 may include a recess 38 formed therein sized and shaped to receive one of the end poles of the magnet 24 to enhance physical and magnetic contact between the magnet and the tip 30. For example, the recess 38 may be spherical or dome shaped to receive a spherically shaped end of the magnet. The probe portion 36 is preferably in the shape of a narrow elongate solid cylinder.

Figure 6:
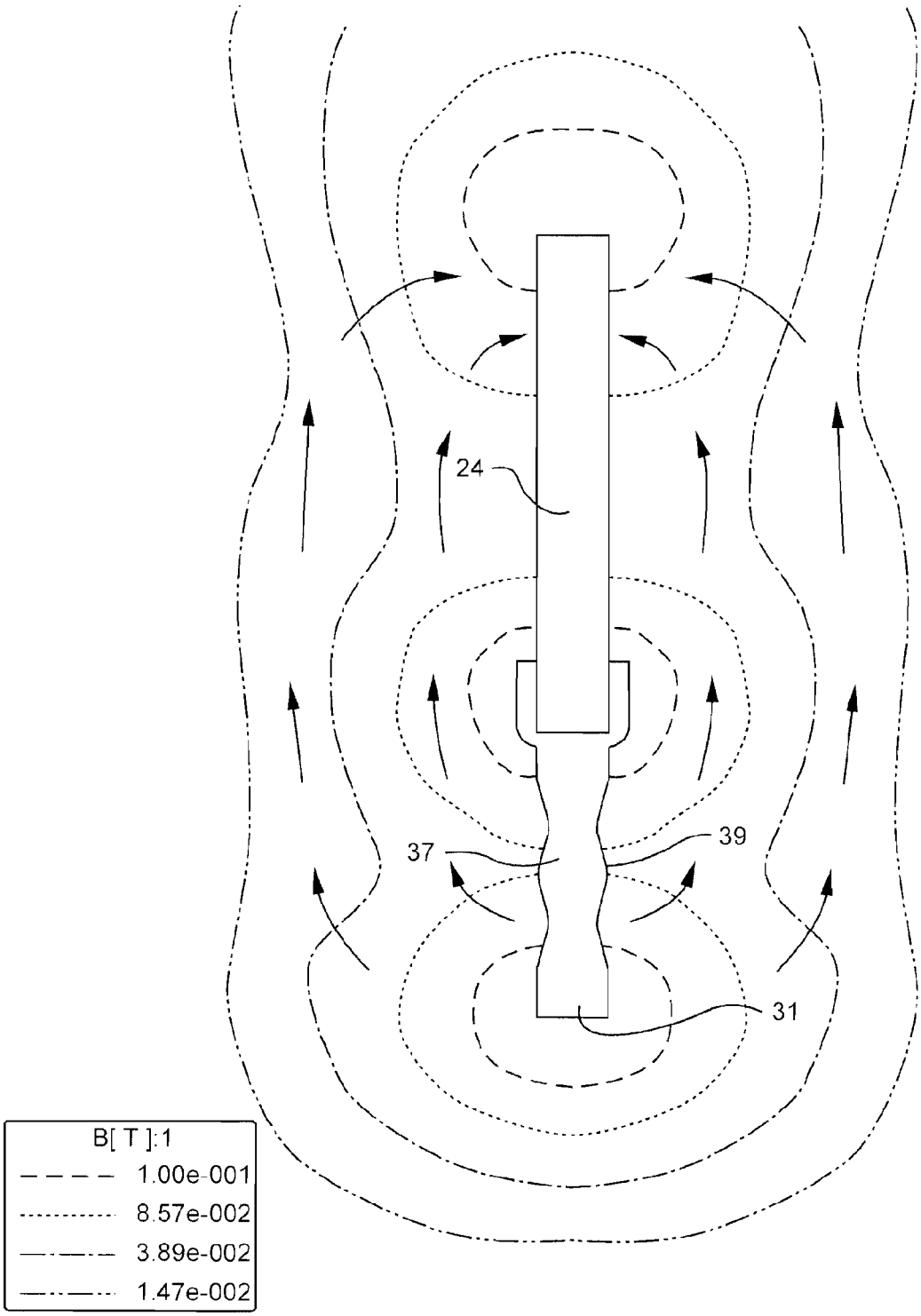
FIG. 6 is a cross-sectional view of an alternative embodiment of a biomagnetic particle transfer pin with a magnetizable tip according to the present invention attached thereto.

Altering the geometry of the tip 30 will thereby change the paths for the magnetic flux and affect the strength and orientation of the attractive force(s) on the particles at various positions around the device. For example, FIG. 6 shows another possible geometry for a tip 31, wherein the tip has a probe portion 37 having a corrugated outer surface 39.

Inserting the tip 30, with an applied magnetic field, into a suspension 14 containing biomagnetic particles 12 imposes a net static collection force (drag force is ignored) on the particles defined by the equation:

$$\vec{F}_{particle} = Volume_{particle}\left[(\mu_{r-particle} - \mu_{r-fluid}) * \vec{\nabla}\left(\frac{1}{2}\vec{B}\square\vec{H}\right) - \vec{g}(\rho_{particle} - \rho_{fluid})\right]$$

Thus, by changing the geometry of the tip 30, the forces 32 applied to the particles 12 can be tailored to the specific application.

Another benefit of the tip 30 according to the present invention is the fact that subjecting the tip 30 to a magnetic field 32 of sufficient strength for a period of time can result in remanent magnetism developing within the tip, allowing for continued operation of the device 10 after the magnetic-field source has been removed. Thus, the material properties of the tip 30 could allow for the sustainment of this remanent field until all of a plurality of devices 10 have been magnetized as desired. As a result, the number of permanent magnets 24 required may be fewer than the number of transfer devices 10 utilized, wherein multiple passes of one or more magnetic-field-source(s) could ensure that the required magnetization for each device was maintained. Release of the magnetic particles could be induced by a de-gaussing magnetic field.

Specifically, the tip 30 can be temporarily magnetized, allowing for the removal of the magnetic-field source once the remanent field is strong enough to attract the biomagnetic particles in suspension and/or retain the particles (against surface tension) that have been attracted to the device (as it is removed from the suspension). This allows for the "customization" of the source's magnetic field, i.e., the magnetic field of a cylindrical electromagnet can be redistributed as required to most effectively attract the biomagnetic particles, while imparting a remanent magnetism onto the collection rod.

Figure 7:
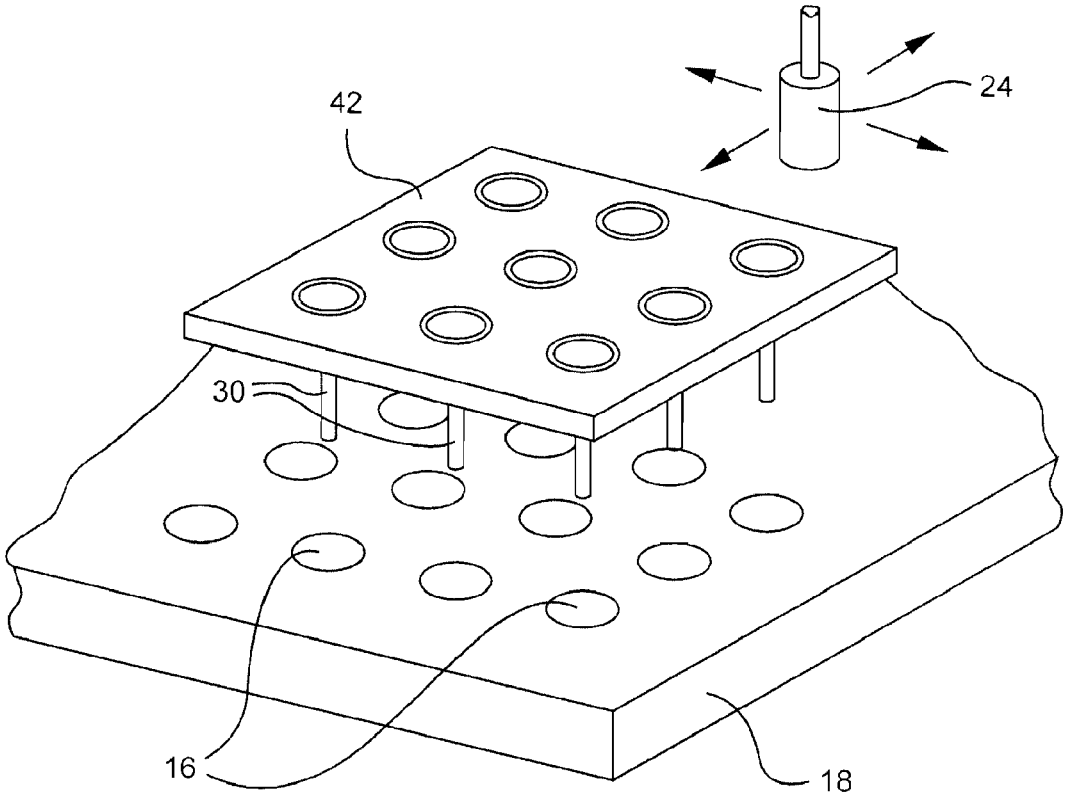
FIG. 7 is a top perspective view of an array of magnetizable tips according to the present invention FIG. 8 a graphical representation of the magnetic force to gravity ratio applied by a transfer device without a magnetizable tip.

For example, FIG. 7 shows a preferred arrangement of an array 40 of magnetizable tips 30 according to the present invention. Such an array 40 is preferably formed by molding a plurality of tips 30 within a plastic frame or skeleton 42. The tips 30 are arranged within the frame 42 to match the spacing and arrangement of wells 16 in a typical micro-well plate 18. It has been found that the divergent tapering between adjacent collection tips 30 generates steeper gradients in the magnetic field.

As mentioned above, the material properties of the tip 30 allows for remanent magnetic fields to be sustained after the tip has been magnetized. Thus, it is possible for an array 40, as shown in FIG. 7, to require only a single magnet 24, or a number of magnets fewer than the number of tips 30, to magnetize all of the tips of the array. This would be accomplished by moving the magnet 24 to make contact with each tip 30 within the array 40. Again, removal of the magnetic field from selected tips 30 can be accomplished with by a de-gaussing process.

The array 40 shown in FIG. 7 shows nine tips 30 for simplicity. However, much larger arrays 40 of the devices 10 could be molded together (e.g., an array of 96 devices molded together for operation with a 96-well microplate).

Moreover, the resulting unitary structure of the array 40 can be easily handled, sterilized and reused as desired. Such structure also facilitates the application of various biological coatings, as described further below, depending on the application. Because of the nature of the structure 40, the coating can be easily removed and reapplied between transferring applications as desired.

As described above, once the particles 12 have been successfully attracted to the device 10, they can be extracted from the suspension 14 and be subsequently deposited into another suspension. This should not exclude the possibility of the particles 12 being transferred to a secondary location within the original suspension, or the flowing of the fluid to bring another volume of fluid into contact with the device. This concept may also find applications in the manipulation of targeted regions of ferrofluids.

It is also envisioned that the tip 30 of the present invention can be coated with biological agents that would react with the agents attached to the biomagnetic beads 12 upon collection. In this regard, the concentrator 30 is again advantageous over a transfer device 10 using a permanent magnet alone.

Also, the surface of the device could be made further functional through various coating processes (e.g., hydrophobic, inert, biological, etc.) to interact with the biomagnetic particles as desired when they contact the device or to address the environment into which they are introduced.

EXAMPLE

Figure 8:
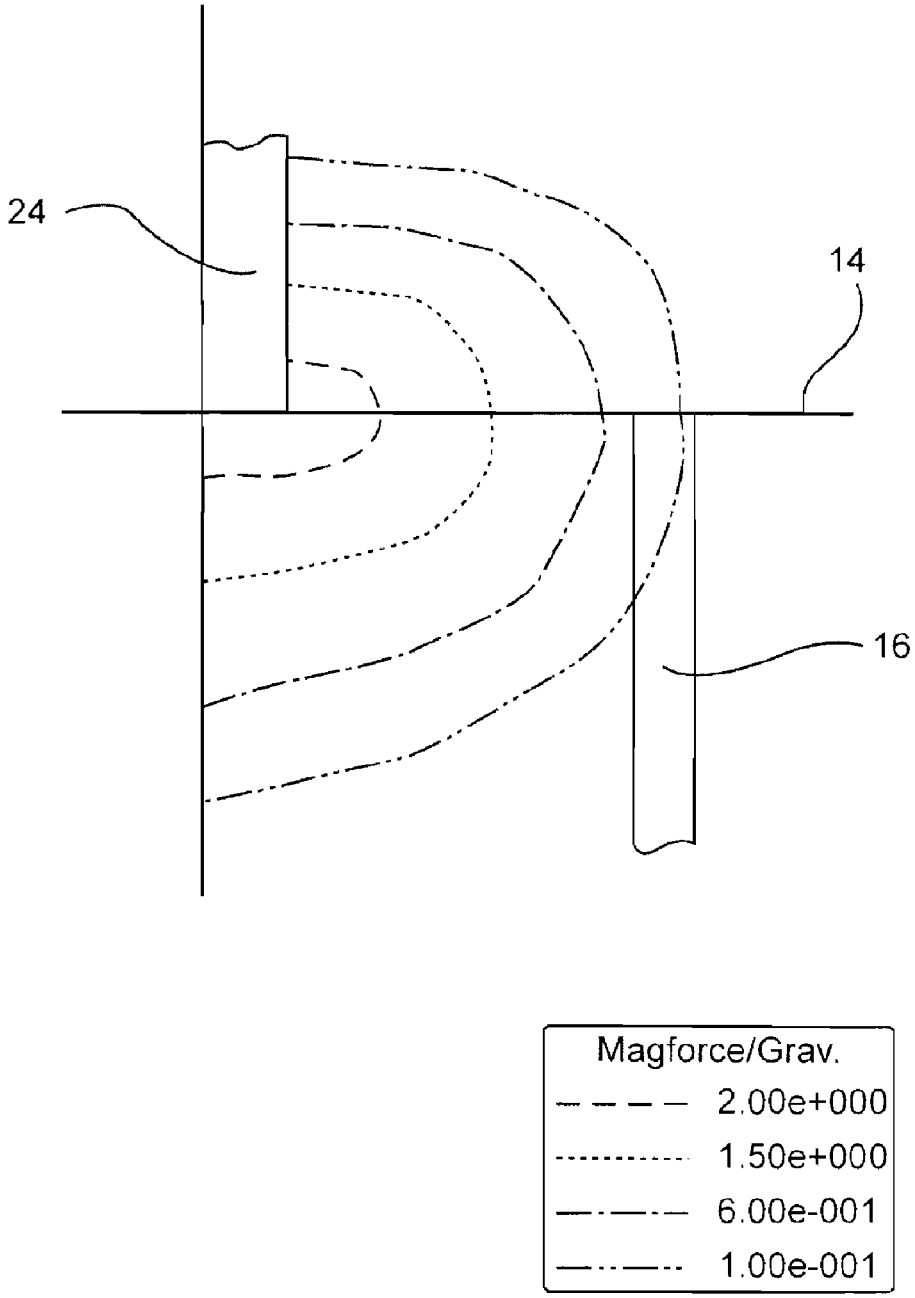

An analysis was conducted for a Ø3 mm×21 mm NdFeB, grade N-45 permanent magnet 24 slidably received in a tubular pin 20. FIG. 8 shows the magnetic force to gravity ratio applied by a transfer device 10 without a magnetizable tip 30 according to the present invention attached thereto. As shown in FIG. 8, without bringing the lower tip of this permanent magnet 24 below the level of the fluid 14 contained within the microplate well 16, the biomagnetic particles 12 held in suspension to a depth of ~7 mm (14 mm-deep wells) would be subjected to a magnetic force twice that of gravity.

Figure 9:
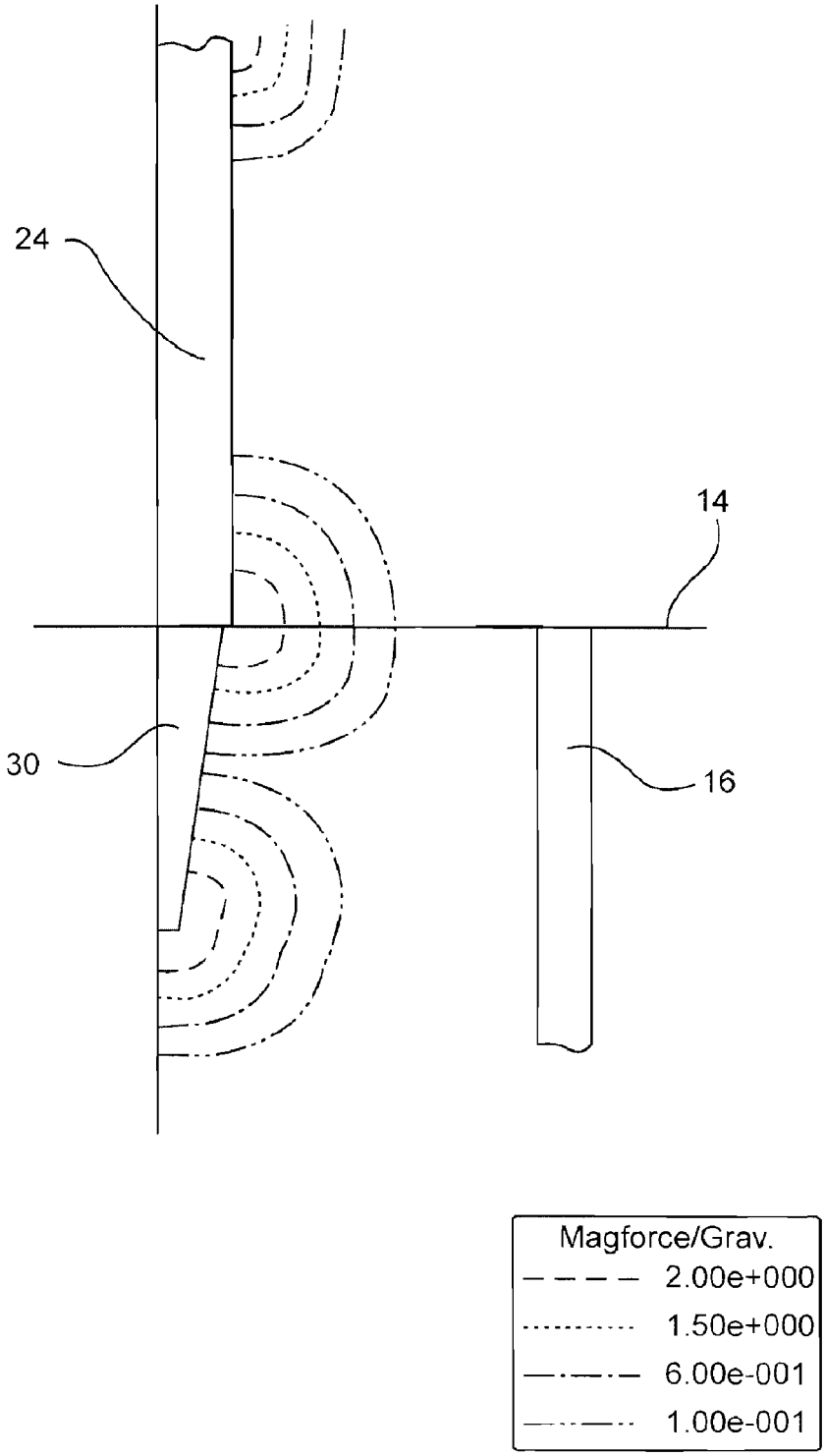
FIG. 9 is a graphical representation of the magnetic force to gravity ratio applied by a transfer device with a magnetizable tip according to the present invention applied thereto.
Figure 10:
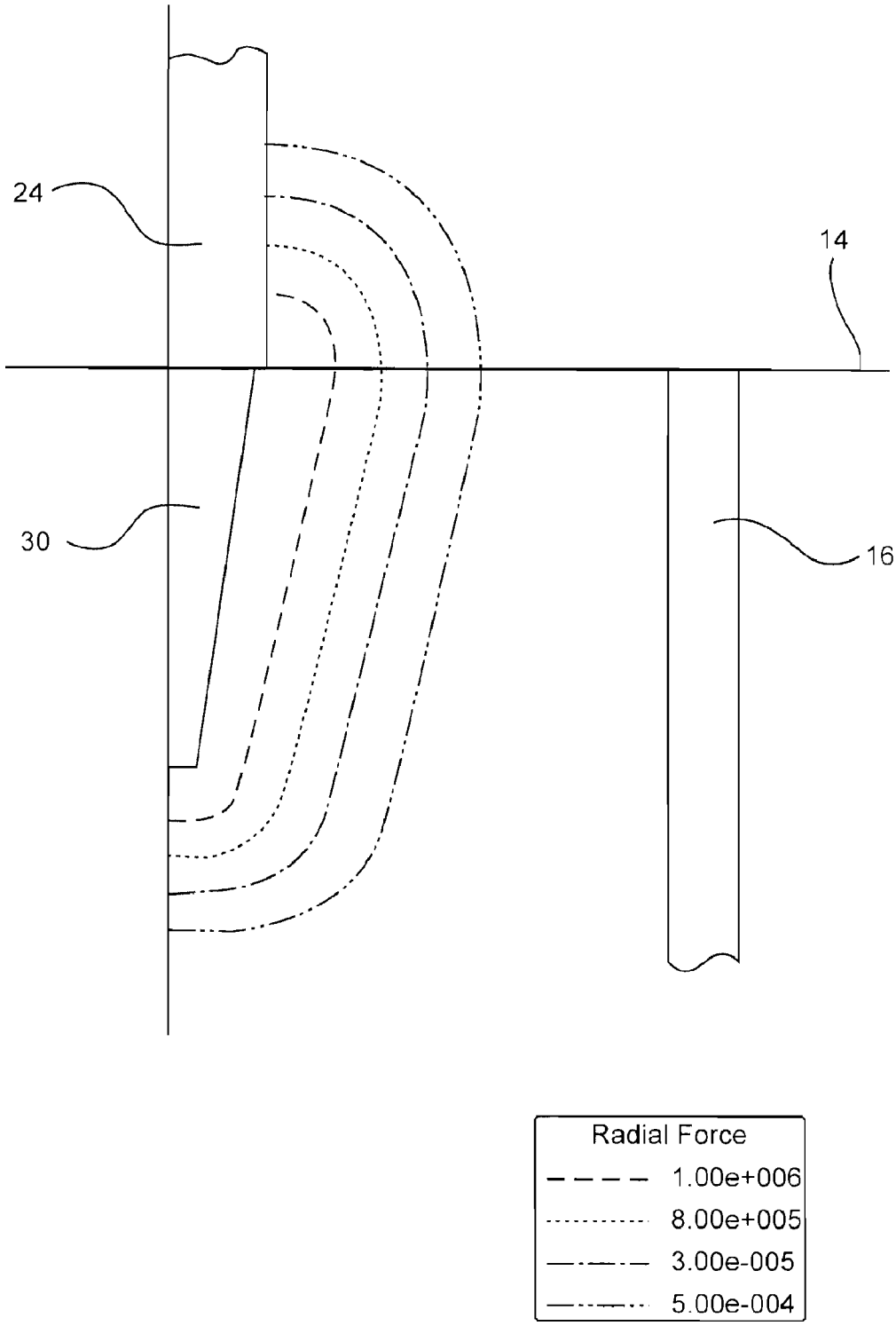
FIG. 10 is an enlarged view of FIG. 9 showing the leftward attractive force along the side of the tip.

Adding a tapered-cylinder flux concentrator tip 30, according to the present invention, to the magnet 24 resulted in the vertical and horizontal G-force-component magnitude plots shown in FIGS. 9 and 10. These simulations indicate that the Ø3 mm×21 mm permanent magnet 24 would successfully collect biomagnetic particles using the collection rod.

The magnet alone (FIG. 8) has an upward force exceeding twice buoyancy-corrected gravity for a depth of about 7 mm in the primary well, while the same upward force with the collection rod 30 extends only about 4 mm deep from the end of the rod (FIG. 9). The leftward attractive force exceeds 1 million N/m3 along the entire side of the concentrator 30 (FIG. 10), while the same force density only occurs for a depth of about 2 mm height near the tip of the magnet alone.

Thus, the concentrator has a smaller region of large upward force but a larger region of large leftward force. Concentrators in adjacent cells appear to have negligible effect.

The concentrator results can be explained as follows. Since magnetic flux density B in air must be normal to steel (high permeability) surfaces, steel flux concentrators naturally have high B normal to their surface and thus have a high force of attraction toward their surface. Thus the flux concentrator will have a high leftward force. This collection force is on the entire steel concentrator surface, not just on the bottom tip which is the case for the present plain permanent magnet. In other words, the collection tip 30 attracts along its entire surface, while the magnet alone attracts primarily at its pole. As a result, the permanent magnet size can be significantly reduced.

As a result of the present invention, a device 10 or an array 40 of such devices is provided, which allows for biomagnetic-particle 12 collection from a suspension 14 contained within wells 16 in close proximity to another (e.g. microplates 18 of 96, 384 and 1536-well pitches 16) without disturbing the adjacent suspension(s) by directing the flux of the applied magnetic field and distributing the applied magnetic field about its surface. Whether alone or in an array, these devices are easily sterilizable or can be made disposable.

Although the preferred embodiments of the present invention have been described with reference to the accompanying drawing, it is to be understood that the invention is not limited to those precise embodiments, and that other changes and modifications may be made by one skilled in the art without departing from the scope or spirit of the invention.

What is claimed is:

1. A biomagnetic particle transfer device comprising:

a pin having a tip end and a magnet element disposed therein, said magnet element having a spherically shaped end pole; and a tip engageable with said tip end of said pin, said tip being made from a highly magnetically permeable material and having a shape adapted to concentrate a magnetic field generated by the magnet element in said pin on said tip, wherein said tip includes a truncated cone-shaped portion and a probe portion, said cone shaped portion defining an attachment end engageable with said tip end of said pin and an apex opposite said attachment end, said probe portion extending from said apex of said cone-shaped portion, and wherein said probe portion is a narrow elongate solid cylinder, and wherein said cone-shaped portion includes a spherically shaped inner recess to receive said spherically shaped end pole of said magnet element of said pin.

2. A transfer device as defined in claim 1 wherein said probe portion of said tip has a corrugated outer surface.

3. A transfer device as defined in claim 1 wherein said tip has a biological agent coating.

4. A biomagnetic particle transfer device comprising:

at least one magnetic element adapted for selectively generating a magnetic field, said magnetic element having a spherically shaped end pole;

a plurality of tips engageable with said magnetic element, each of said tips being made from a highly magnetically permeable material and having a shape adapted to concentrate the magnetic field generated by said magnetic element on said tip, wherein each of said tips includes a truncated cone-shaped portion and a probe portion, said cone shaped portion defining an attachment end engageable with said magnetic element and an apex opposite said attachment end, said probe portion extending from said apex of said cone-shaped portion, and wherein said probe portion is a narrow elongate solid cylinder, and wherein said cone-shaped portion includes a spherically shaped inner recess to receive said spherically shaped end pole of said magnetic element; and a unitary frame supporting said plurality of tips.

5. A transfer device as defined in claim 4, wherein the device comprises fewer magnetic elements than tips.

* * * * *